US010690456B1

(12) United States Patent
Bitar

(10) Patent No.: US 10,690,456 B1
(45) Date of Patent: Jun. 23, 2020

(54) ENERGY BEAM INTERCEPTOR

(71) Applicant: Peter V. Bitar, Anderson, IN (US)

(72) Inventor: Peter V. Bitar, Anderson, IN (US)

( * ) Notice: Subject to any disclaimer, the term of this patent is extended or adjusted under 35 U.S.C. 154(b) by 2426 days.

(21) Appl. No.: 13/836,077

(22) Filed: Mar. 15, 2013

Related U.S. Application Data

(60) Provisional application No. 61/637,343, filed on Apr. 24, 2012.

(51) Int. Cl.
*G01C 21/02* (2006.01)
*F41H 13/00* (2006.01)

(52) U.S. Cl.
CPC ..... *F41H 13/0043* (2013.01); *F41H 13/0062* (2013.01)

(58) Field of Classification Search
CPC ..... F41H 13/0043; F41H 13/0062; F41H 13/0068; F41H 13/0075; F41H 13/0081
USPC ..... 250/203.2
See application file for complete search history.

(56) References Cited

U.S. PATENT DOCUMENTS

| | | | | |
|---|---|---|---|---|
| 5,192,827 | A | 3/1993 | Jasper, Jr. | |
| 6,614,012 | B2 * | 9/2003 | Schneider | F41G 7/305 244/3.1 |
| 6,981,671 | B1 | 1/2006 | Baron et al. | |
| 7,641,153 | B2 | 1/2010 | Smereczniak | |
| 7,667,634 | B2 | 2/2010 | Shin et al. | |
| 7,946,209 | B2 * | 5/2011 | Schneider | F42C 11/04 124/3 |
| 8,096,507 | B2 | 1/2012 | Cain et al. | |
| 2003/0233931 | A1 | 12/2003 | Nemtsev | |
| 2007/0114322 | A1 | 5/2007 | Smereczniak | |
| 2009/0224610 | A1 | 9/2009 | Fuks et al. | |
| 2009/0242702 | A1 | 10/2009 | Cain et al. | |
| 2016/0097616 | A1 * | 4/2016 | Weigold | F41H 13/0062 250/396 R |

OTHER PUBLICATIONS

Airborne tactical laser website; located at https://www.google.com/search?q=airborne@tactical@laster&tbm=isch&tbo=u&source=univ&sa=X&ei=1.
Defense Update: Conducts First Tests of High Power Microwave (HPM) Missle; located at http://defense-update.com/20110922_boeing-tests-champ-hpm-missil.html.
Magellan Aerospace; located at http://www.magellan.aero/our-products/rockets-and-space/.
Raytheon—AN/APG-79 AESA Radar Active Electronically Scanned Array; located at http://www.raytheon.com/capabilities/products/apg79aesa/.

* cited by examiner

*Primary Examiner* — Mark Hellner
(74) *Attorney, Agent, or Firm* — Woodard, Emhardt, Henry, Reeves & Wagner, LLP

(57) ABSTRACT

Disclosed is an energy beam interceptor that includes an interceptor vehicle of either a missile or a lighter than air vehicle that carries an energy beam generator with a minimum power output of approximately 500 W, a high density power supply that power the energy beam generator, an energy beam targeting apparatus that directs emissions from the energy beam generator and an energy beam targeting controller that targets emissions from the energy beam generator with the energy beam targeting apparatus.

20 Claims, 7 Drawing Sheets

ENERGY BEAM INTERCEPTOR

DETAILED DESCRIPTION

Figure 1:
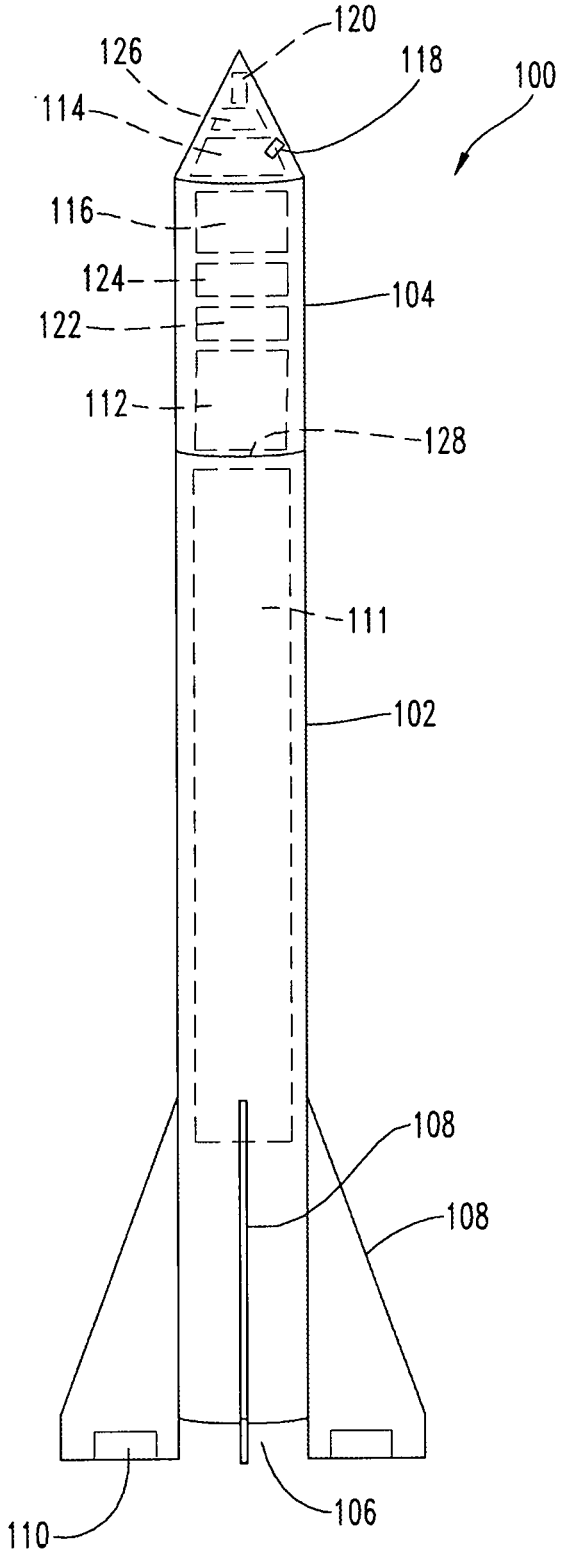
FIG. 1 is an elevational view of a rocket mounted energy beam interceptor.

Reference will now be made to certain embodiments and specific language will be used to describe the same. It will nevertheless be understood that no limitation of the scope of this disclosure and the claims are thereby intended, such alterations, further modifications and further applications of the principles described herein being contemplated as would normally occur to one skilled in the art to which this disclosure relates. In several figures, where there are the same or similar elements, those elements are designated with the same or similar reference numerals.

There are known prior art systems used for intercepting airborne missiles and aircraft including missiles and directed-energy emission systems such as lasers. Intercept missiles generally require terminal guidance to obtain a close proximity intercept with the target to bring the intercepting missile within range of either a proximity explosive or direct kinetic impact (with or without an explosive warhead).

Directed-energy emission systems have been developed that are land, sea and air based (on large airframes). Directed-energy emission systems generally required very powerful energy emissions to overcome energy losses from traveling long distances through the atmosphere to deliver sufficient energy to a target to destroy or disable the target. The long ranges involved require precise targeting to maintain the directed-energy beam on the target for sufficient time to deliver sufficient energy to destroy or disable the target. The powerful energy emissions require correspondingly powerful power sources.

The energy beam interceptor disclosed herein combines aspects of both prior art systems to overcome some of the deficiencies in the prior art systems. The energy beam interceptor includes a comparatively smaller energy emitter with a comparatively reduced effective range combined with a vehicle that is capable of located the energy emitter close enough to a target missile or aircraft for the comparatively smaller energy beam to deliver sufficient energy to the target to disable or destroy it.

Referring to FIG. 1, FIG. 1 illustrates interceptor 100. Interceptor 100 includes missile body 102 and emission subassembly 104. Missile body 102 includes propulsion system 106, fins 108, control surfaces 110 and fuel 111.

Emission subassembly 104 includes power supply 112, energy beam generator 114, gimbal 116, emitter 118, sensor 120, missile targeting controller 122, energy beam targeting controller 124, targeting emitter 126 and recovery device 128.

Missile body 102 may represent a conventional missile body. For example, a modified sounding rocket, 5MS, 5M3 or any other high altitude rocket or missile with the payload capacity to deliver emission subassembly 104 in the proximity to a target. In this regard, propulsion system 106 and fuel 111 can be integrated as an unitary system. For example, utilizing a solid-fuel as fuel 111 with emissions directed through a nozzle defining propulsion system 106. In other embodiments, fuel 111 can be a single or duel component fuel with propulsion system 106 being a rocket engine reacting fuel 111 to produce thrust. In any event, missile body 102 is intended to encompass any type of high velocity high altitude missile known or later developed that accomplishes the goal of delivering emission subassembly 104 into relatively close range of a target. In one example, missile body 102 has a payload capacity exceeding 500 lbs (227 kg) with an flight ceiling in excess of 250,000 feet (76.2 km).

Emission subassembly 104 includes energy beam generator 114 configured to emit an energy beam with sufficient range and power to destroy or disable an intended target. There are many possible types of energy beam generator 114 producing many different type of energy beams including, but not limited to: electron beam, microwave beam (MASER), neutron beam, particle beam, gamma ray beam, x-ray beam, magnetic residence beam, high voltage arc, directed electromagnetic pulse and directed laser light including solid state infrared lasers, laser light, solid state ultraviolet laser, solid state laser in a visible spectrum. Sources of such laser lights can include fiber laser, a carbon dioxide laser, an argon laser, chemical laser, Excimer laser, Exiplex laser or any other type of laser.

Power supply 112 is configured to meet the energy requirements of the energy beam generator 114 for a particular application. Power supply 112 may include a battery or capacitor bank configured to store electrical charge. In general, a type of battery or capacitor having a high energy density is beneficial as well as a battery or capacitor with the capacity for high discharge rate to provide the load required to operate energy beam generator 114. Power supply 112 may also optionally include power converting circuitry to modify the voltage and/or current provided by an electrical storage device. For example, a transformer or a solid state power converter.

In other embodiments, power supply 112 may include storage of chemical reagents reactive in energy beam generator 114 to produce the desired energy emission. In yet other embodiments, power supply 112 may include a voltaic or a fuel cell.

Gimbal 116 and emitter 118 are configured to direct the energy emission of energy beam generator 114. Gimbal 116 may move both energy beam generator 114 and emitter 118 or alternatively only emitter 118 depending on the configuration of the emission subassembly 104. Emitter 118 may optionally include some form of collimation to focus the emitted energy beam. In one example, emitter 118 collimates an emitted laser energy beam to less than 12 inches (30.5 cm) diameter in a target zone.

Emitter 118 and/or gimbal 116 may be incorporated directly with energy beam generator 114 depending on their configuration. Gimbal 116 may include one or more separate gimbals mounted to work together to provide increased degrees of freedom. In one example, gimbal 116 provides at least 300 degrees-in-all-axes rotation of emitter 118.

Sensor 120 is configured to detect external signals and provide information to missile targeting controller 122 and energy beam targeting controller 124. Sensor 120 may include a wide variety of sensors including, but not limited to, visible light sensors such as a video camera, a radar receiver, a laser receiver, a heat sensor or any other known type of sensor utilized for airborne targeting.

Missile targeting controller 122 includes a processor unit configured to guide the targeting of interceptor 100. Missile targeting controller 122 is configured to receive input from sensor 120 and may be configured to control propulsion system 106 and control surfaces 110. Note that in some embodiments control surfaces 110 may be omitted and control may be provided exclusively through propulsion system 106. For example, in embodiments where propulsion 106 includes some form of vectored thrust.

Energy beam targeting controller 124 is a processor system configured to aim emitter 118 via gimbal 116 and to initiate energy beam generator 114. Energy beam targeting controller 124 may receive input from sensor 120. Energy beam targeting controller 124 may also include target recognition capacity to identify a target from information from sensor 120. For example, energy beam targeting controller 124 may be programmed to recognize the shape of various known targets, for example known missiles, from various angles of inclination.

Targeting emitter 126 may be optionally included. Targeting emitter 126 is configured to emit radiation used in targeting and sensed by sensor 120. For example, targeting emitter 126 may be a radar emitter.

Recovery device 128 may optionally be included. Missile body 102 may optionally be separable from emission subassembly 104. Recovery device 128 may optionally provide a mechanism to deliver emission subassembly 104 to the earth after use. In one embodiment, recovery device 128 includes a parachute. Recovery device 128 may also include shock absorption system such as an inflatable balloon to absorb impact when landing. Recovery device 128 may also include a flotation mechanism to keep the emission subassembly 104 above the surface of any water that it lands.

Referring now to FIGS. 2-6, various control and targeting configuration for interceptor 100 are illustrated.

Figure 2:
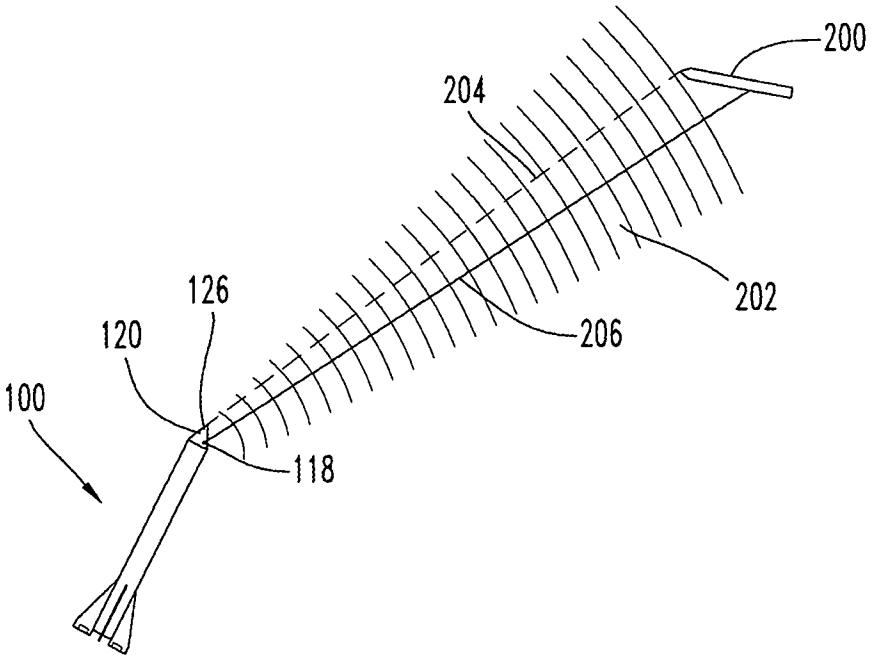
FIG. 2 is a perspective view of the FIG. 1 rocket mounted energy beam interceptor intercepting a target.

Referring to FIG. 2, interceptor 100 is illustrated intercepting target 200. Interceptor 100 includes sensor 120 and targeting emitter 126. In the illustrated embodiment, targeting emitter 126 emits targeting emission 202 that is reflected off of target 200 producing return signal 204 which is detected by sensor 120. Based upon the input received by sensor 120, energy beam targeting controller 124 targets emitter 118 and initiates generation of energy beam 206 from energy beam generator 114 targeted upon target 200.

Figure 3:
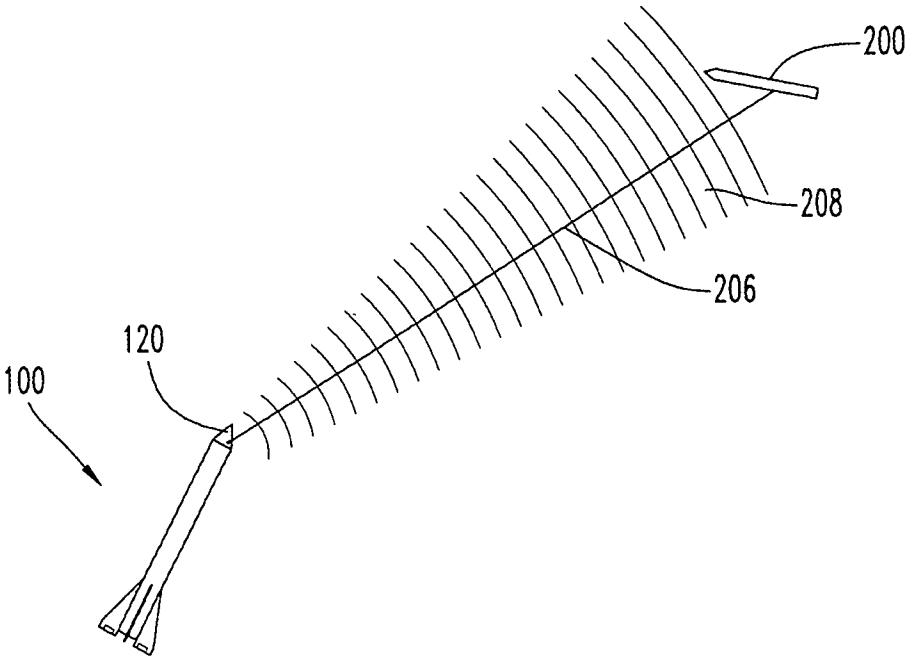
FIG. 3 is a perspective view of the FIG. 1 rocket mounted energy beam interceptor intercepting a target.

Referring to FIG. 3, an alternate control scheme is illustrated. In FIG. 3 target 200 emits target emissions 208 which are detected by sensor 120. Energy beam targeting controller 124 targets emitter 118 and initiates generation of energy beam 206 from energy beam generator 114 targeted upon target 200. Target emissions 208 may include, but are not limited to infrared heat emissions and/or visible light reflections from external sources such as the sun that are received and detected by sensor 120 on interceptor 100.

Figure 4:
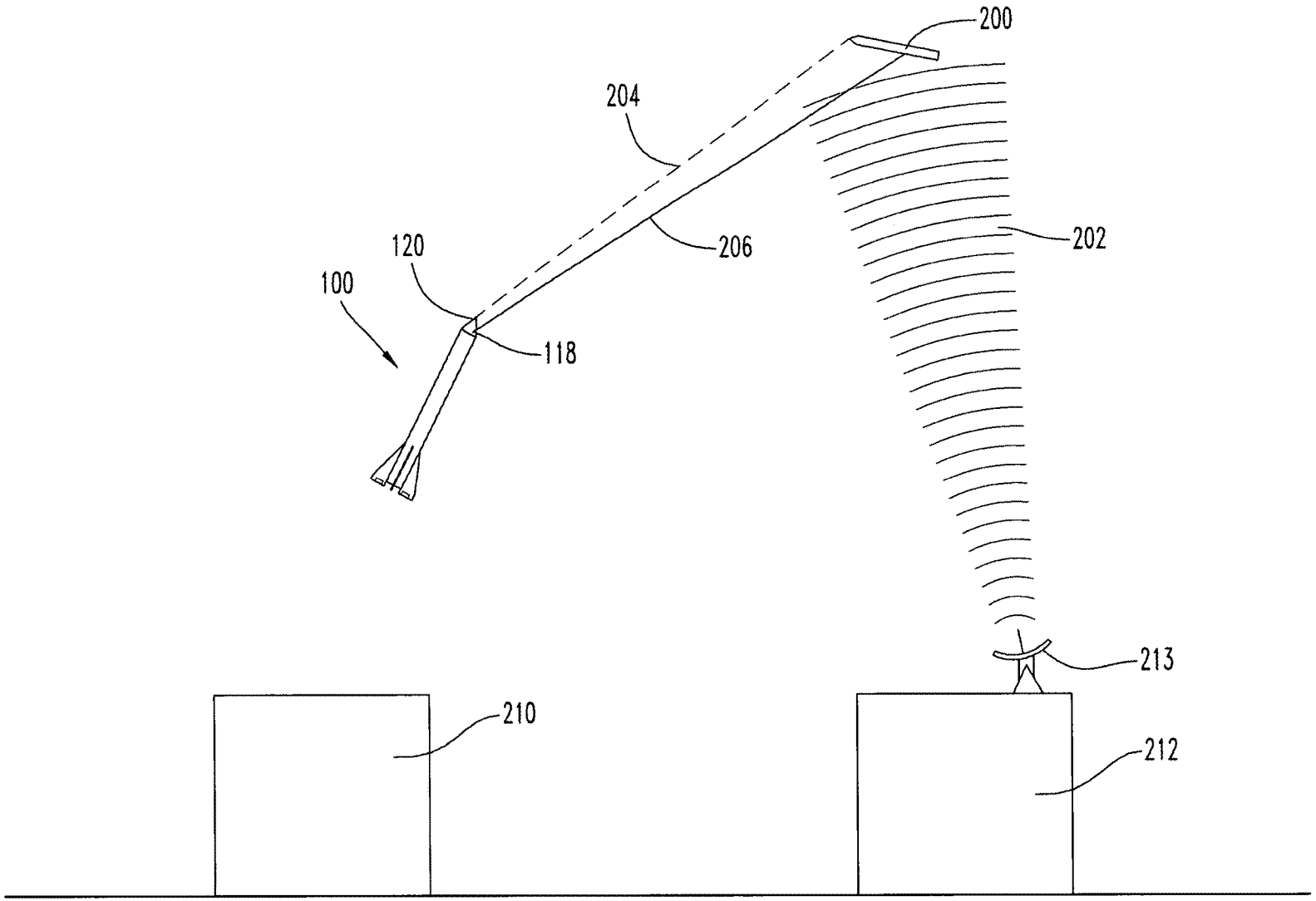
FIG. 4 is a view of the FIG. 1 rocket mounted energy beam interceptor intercepting a target also showing a launch platform in a sensor platform.

Referring to FIG. 4, another control scheme is illustrated including launch platform 210 and sensor platform 212. Interceptor 100 is launched from launch platform 210 and is guided to target 200 by detecting reflected emissions from sensor platform 112. In particular, targeting emissions 202 are emitted from targeting emitter 213 on sensor platform 212. Targeting emissions 202 reflect off of target 200 creating return signal 204 which is detected by sensor 120 on interceptor 100. Based on the detected return signal 204, energy beam targeting controller 124 targets emitter 118 and initiates emission of energy beam 206 targeted on target 200.

Figure 5:
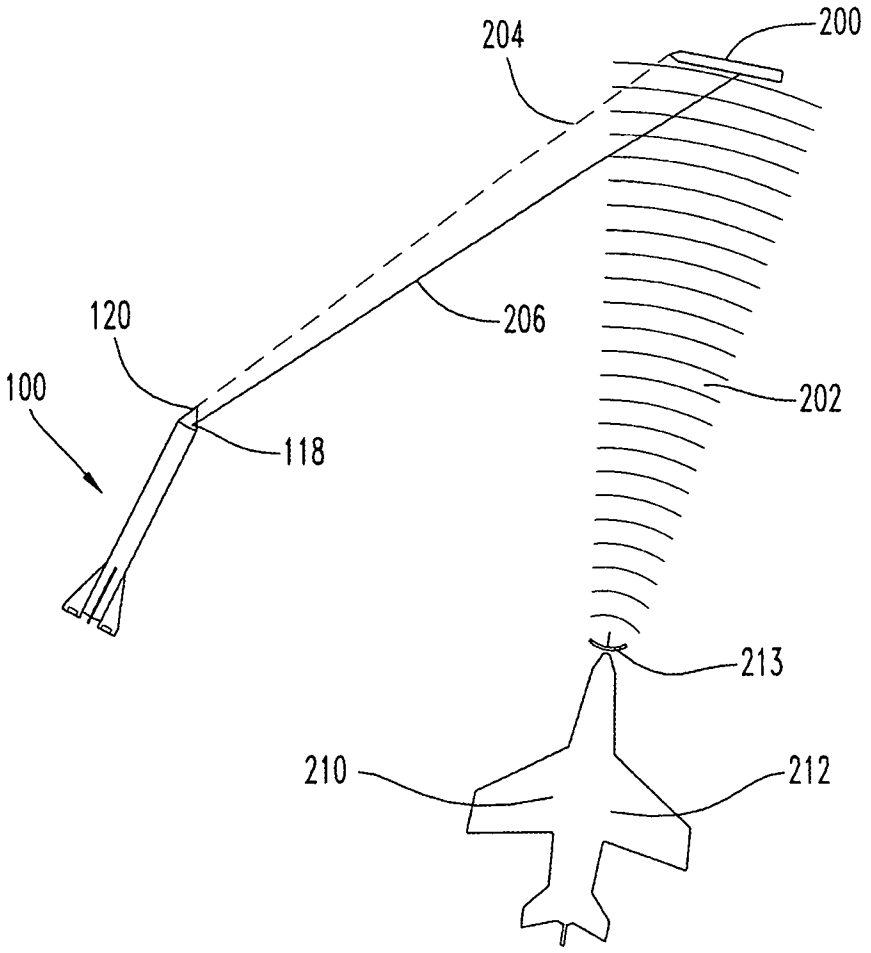
FIG. 5 is a view of the FIG. 1 rocket mounted energy beam interceptor intercepting a target also showing a launch platform in a sensor platform.

Referring to FIG. 5, yet another control scheme is illustrated. In FIG. 5, launch platform 210 and sensor platform 212 are the same unit. Sensor platform 212 includes targeting emitter 213 that emits targeting emissions 202 that reflect off of target 200 forming return signal 204 received by sensor 120 on interceptor 100. Energy beam targeting controller 124 targets emitter 118 on target 200 and initiates emission of energy beam 206 targeted on target 200.

Figure 6:
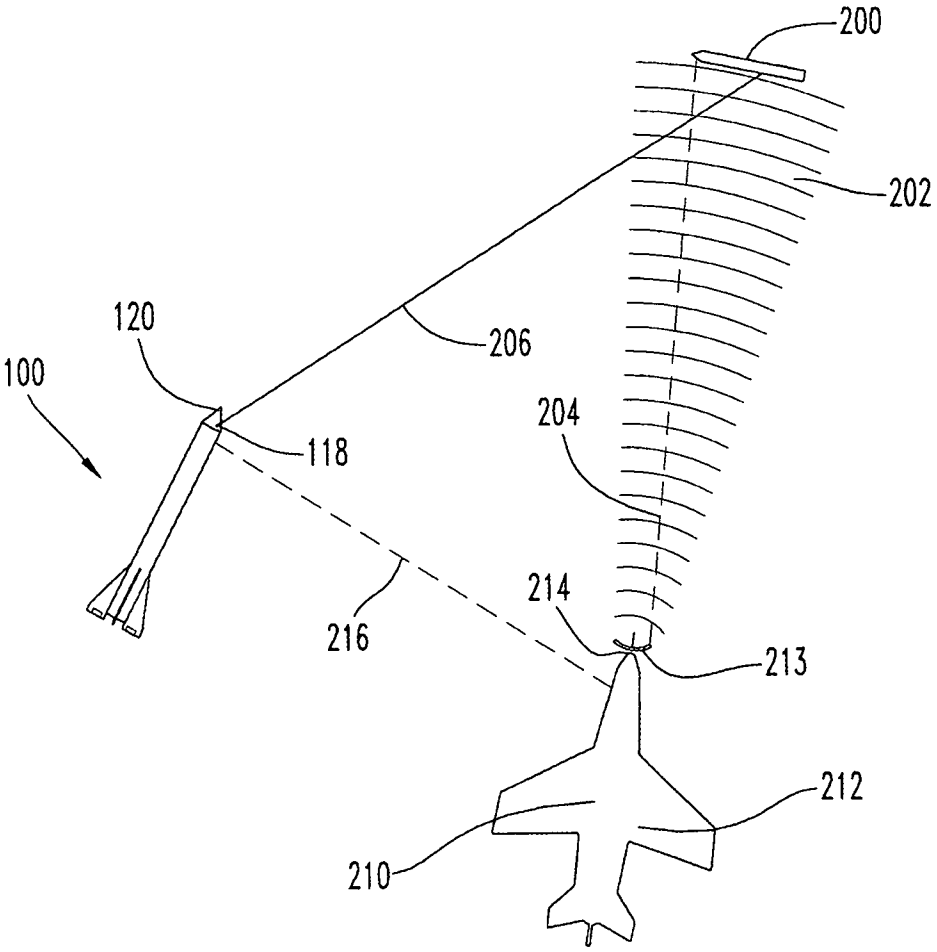
FIG. 6 is a view of the FIG. 1 rocket mounted energy beam interceptor intercepting a target also showing a launch platform in a sensor platform.

Referring to FIG. 6, an alternate control scheme is illustrated. Once again, launch platform 210 and sensor platform 212 are integrated as a single unit. Sensor platform 212 includes targeting emitter 213 and sensor 214. Targeting emitter 213 emits targeting emissions 202 which reflect off of target 200 forming return signal 204 which is detected by sensor 214 on sensor platform 212. Sensor platform 212 then communicates target information to interceptor 100 by command signal 216 that is received by sensor 120. Based on the received information, energy beam targeting controller 124 targets emitter 118 on target 200 and emits energy beam 206 targeted on target 200.

Referring to FIGS. 4-6, launch platform 210 and sensor platform 212 may be various platforms including but not limited to land vehicles, waterborne vehicles and aircraft. Launch platform 210 and sensor platform 212 may also be a permanent ground base installations. Launch platform 210 and sensor platform 212 may be separate units or integrated together. Illustrated components can be further separated or moved, for example, targeting emitter 213 may optionally be moved to a separate unit from sensor 214.

Energy beam generator 114 has a minimum power output of approximately 500 watts. In another embodiment, energy beam generator 114 has a minimum power output of approximately 3,000 watts.

Interceptor 100 is configured to bring energy beam generator 114 into relative close proximity of target 200 permitting the use of a comparatively lower powered energy beam generator 114 with capacity to still deliver a damaging or destructive shot of energy to target 200. This approach does not require interceptor 100 to physically hit target 200 but just get close, for example, within a mile or so of target 200 so that the relatively lower powered energy beam generator 114 has sufficient energy (over time) to destroy or disable target 200.

Current technology uses either extremely powerful long range lasers to target airborne targets from 10 s or 100 s of miles away or use interceptor missiles to directly connectively impact the incoming target. Interceptor 100 utilizes both technologies minimizing complexity in targeting and energy emissions from the energy beam emitter 114 and also minimizing complexities in targeting required to obtain a kinetic impact with a high speed target.

Power supply 112 may be configured to provide a limited number short duration, high power output(s) to power relatively small number of shots while minimizing payload requirements.

Interceptor 100 may be configured for use with a wide variety of launch platforms 210. For example, launch platform 210 could be a ground vehicle, a stationary ground missile battery, a ship, an airplane, an airship or a high-altitude balloon. Launch platform 210 may be manned or remote controlled.

Figure 7:
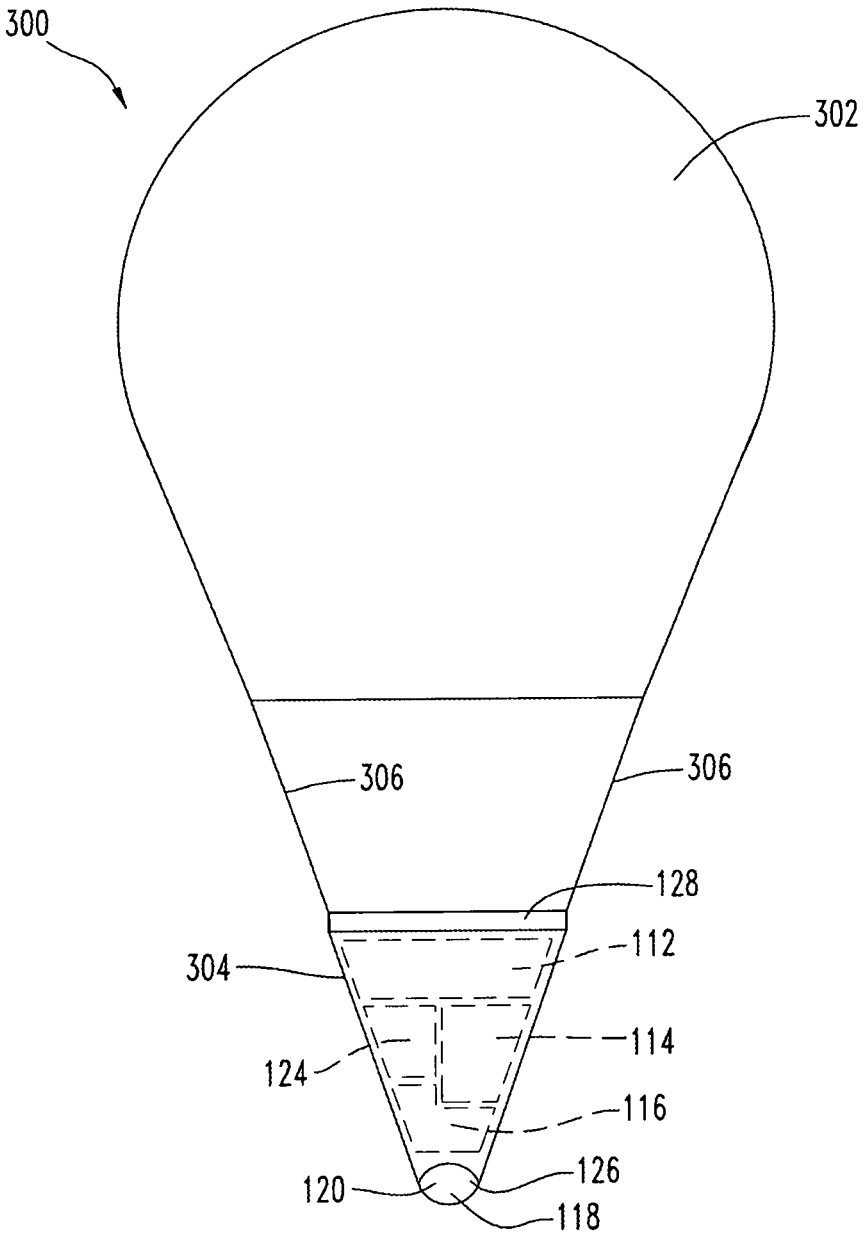
FIG. 7 is an elevational view of a Lighter-Than-Air vehicle mounted energy beam interceptor.

Another option for an energy beam interceptor is to mount emission subassembly 104 on a high-altitude Lighter-Than-Air (LTA) craft or balloons to loft energy beam generator and emitter 118 to sufficient altitude to intercept missiles passing nearby. In sufficient numbers, LTA mounted energy beam interceptors could create a static shield or defensive perimeter in anticipation of an attack. Such a static defensive perimeter could also be augmented by one or more interceptors 100 launched from defensive vehicles such as other LTA, interceptor aircraft or ground based installations or vehicles. Energy emissions from several sources could be combined on a single target to increase the likelihood of successfully destroying or disabling Referring to FIG. 7, interceptor 300 is illustrated. Interceptor 300 include Lighter-Than-Air vehicle 302 (LTA vehicle 302) and emission subassembly 304 connected by tethers 306. Emission subassembly 304 includes power supply 112, energy beam generator 114, gimbal 116, emitter 118, sensor 120, energy beam targeting controller 124, targeting emitter 126 and recovery device 128. While not illustrated, LTA vehicle 302 may optionally includes controlled mechanisms to control altitude and position.

Other than being comparatively stationary, interceptor 300 may be targeted in a similar manner as interceptor 100. Any of the targeting and control schemes illustrated in FIGS. 2-6 may be utilized with interceptor 300. As described above, interceptor 300 may operate as part of a larger network of interceptors 100 and 300. Interceptor 300 may be configured for remote control an coordination as part of such a network.

Recovery device 128 and/or tethers 306 may optionally be configured to permit controlled separation of emission subassembly 304 from LTA vehicle 302. As discussed above, recovery device 128 may optionally provide a mechanism to deliver emission subassembly 304 to the earth after use. In one embodiment, recovery device 128 includes a parachute. Recovery device 128 may also include shock absorption system such as an inflatable balloon to absorb impact when landing. Recovery device 128 may also include a flotation mechanism to keep the emission subassembly 304 above the surface of any water that it lands.

This disclosure serves to illustrate and describe the claimed invention to aid in the interpretation of the claims. However, this disclosure is not restrictive in character because not every embodiment covered by the claims is necessarily illustrated and described. All changes and modifications that come within the scope of the claims are desired to be protected, not just those embodiments explicitly described.

I claim:

1. An energy beam interceptor comprising:

a missile;

an energy beam generator with a minimum power output of approximately 500 W, wherein the energy beam generator is mounted on the missile;

a high density power supply constructed and arranged to power the energy beam generator, wherein the high density power supply is mounted on the missile;

an energy beam targeting apparatus constructed and arranged to direct emissions from the energy beam generator, wherein the energy beam targeting apparatus is mounted on the missile; and an energy beam targeting controller constructed and arranged to target emissions from the energy beam generator with the energy beam targeting apparatus.

2. The energy beam interceptor of claim 1, wherein the missile has a payload capacity exceeding 300 lbs with a flight ceiling exceeding 250,000 feet.

3. The energy beam interceptor of claim 1, wherein the energy beam generator has a minimum power output of approximately 3 kW.

4. The energy beam interceptor of claim 1, further comprising a sensor configured to detect external electromagnetic signals.

5. The energy beam interceptor of claim 4, wherein the sensor is selected from the group comprising: visible light sensor, radar receiver, laser receiver and heat sensor.

6. The energy beam interceptor of claim 4, further comprising a targeting emitter.

7. The energy beam interceptor of claim 6, wherein the targeting emitter is a radar emitter.

8. The energy beam interceptor of claim 1, further comprising a recovery device constructed and arranged to safely deliver the energy beam generator to the earth after use.

9. The energy beam interceptor of claim 8, wherein the recovery device and the energy beam generator are selectively separable from the missile.

10. The energy beam interceptor of claim 1, further comprising a missile targeting controller constructed and arranged to control the flight path of the missile.

11. An energy beam interceptor comprising:

a lighter than air vehicle;

an energy beam generator with a minimum power output of approximately 500 W, wherein the energy beam generator is mounted on the lighter than air vehicle;

a high density power supply constructed and arranged to power the energy beam generator, wherein the high density power supply is mounted on the lighter than air vehicle;

an energy beam targeting apparatus constructed and arranged to direct emissions from the energy beam generator, wherein the energy beam targeting apparatus is mounted on the lighter than air vehicle; and an energy beam targeting controller constructed and arranged to target emissions from the energy beam generator with the energy beam targeting apparatus.

12. The energy beam interceptor of claim 11, wherein the energy beam generator has a minimum power output of approximately 3 kW.

13. The energy beam interceptor of claim 11, further comprising a sensor configured to detect external electromagnetic signals.

14. The energy beam interceptor of claim 13, wherein the sensor is selected from the group comprising: visible light sensor, radar receiver, laser receiver and heat sensor.

15. The energy beam interceptor of claim 13, further comprising a targeting emitter.

16. The energy beam interceptor of claim 15, wherein the targeting emitter is a radar emitter.

17. The energy beam interceptor of claim 11, further comprising a recovery device constructed and arranged to safely deliver the energy beam generator to the earth after use.

18. The energy beam interceptor of claim 17, wherein the recovery device and the energy beam generator are selectively separable from the lighter than air vehicle.

19. A method of intercepting an airborne target comprising:

launching a missile carrying an energy beam generator with a minimum power output of approximately 500 W, a high density power supply constructed and arranged to power the energy beam generator, an energy beam targeting apparatus constructed and arranged to direct emissions from the energy beam generator, and an energy beam targeting controller constructed and arranged to target emissions from the energy beam generator with the energy beam targeting apparatus;

identifying the target;

targeting the energy beam generator at the target; and firing the energy beam generator at the target when the target is within one mile distance from the missile.

20. The method of claim 19 further comprising:

emitting radar energy from a targeting emitter on the missile:

detecting the radar energy with a radar receiver on the missile;

controlling the flight path of the missile with a missile targeting controller based at least in part on detected radar energy; and targeting the energy beam generator at the target based at least in part on detected radar energy.

* * * * *